US006693947B1

(12) United States Patent
Schroeder

(10) Patent No.: US 6,693,947 B1
(45) Date of Patent: Feb. 17, 2004

(54) METHOD TO PROTECT THE ANODE BOTTOMS IN BATCH DC ELECTRIC ARC FURNACE STEEL PRODUCTION

(75) Inventor: David L. Schroeder, Sewickley, PA (US)

(73) Assignee: D. L. Schroeder & Associates, Pittsburgh, PA (US)

( * ) Notice: Subject to any disclaimer, the term of this patent is extended or adjusted under 35 U.S.C. 154(b) by 36 days.

(21) Appl. No.: 10/255,736

(22) Filed: Sep. 25, 2002

(51) Int. Cl.[7] ..... F27D 3/00
(52) U.S. Cl. ..... 373/79; 373/108; 266/44
(58) Field of Search ..... 373/60–63, 71–72, 373/79, 83, 84, 108, 2, 78; 266/45, 175, 233, 236, 240, 245, 44; 75/10.45, 10.39

(56) References Cited

U.S. PATENT DOCUMENTS 2,783,990 A * 3/1957 Tripmacher et al. ..... 266/233
3,561,743 A 2/1971 Schroeder et al.
3,985,545 A 10/1976 Kinoshita
4,740,989 A * 4/1988 Steipe et al. ..... 373/78
5,462,259 A * 10/1995 Guido ..... 266/45
6,024,912 A 2/2000 Wunsche
6,238,452 B1 5/2001 Kremer et al.
6,269,112 B1 * 7/2001 Poloni et al. ..... 373/84

* cited by examiner

*Primary Examiner*—Tu Ba Hoang
(74) *Attorney, Agent, or Firm*—Daniel P. Cillo; Eckert Seamans Cherin & Mellott, LLC

(57) ABSTRACT

A batch process for an electric arc furnace (1) to manufacture steel (10) includes the steps of providing an empty furnace having a bottom (14) and sides (16) and electrodes (2, 3); adding molten metal to the empty furnace; adding other necessary ingredients through charge openings (26); applying current to provide an arc (4) and supplying oxygen through an oxygen lance (6) to react and melt the contents of the furnace and form a top slag (9) and bottom molten metal/steel (10); and stopping the reaction and pouring out all the slag through a slag tap (5) and molten metal tap (32) to provide an empty furnace for the next batch run.

13 Claims, 4 Drawing Sheets

METHOD TO PROTECT THE ANODE BOTTOMS IN BATCH DC ELECTRIC ARC FURNACE STEEL PRODUCTION

BACKGROUND OF THE INVENTION

1. Field of the Invention

This invention relates to a method to prevent erosion of the bottom DC electric arc furnace electrodes, while allowing a full tap of the furnace metal heat.

2. Description of the Prior Art

Modern steel production has advanced from the open hearth process requiring from 8 to 20 hours, to more modern processes such as the basic oxygen furnace steel making process which use a lance to blow oxygen into the furnace to produce a heat, where the blowing time is less than 25 minutes. By the term "heat" is meant the product of one run. In a basic oxygen furnace, the molten metal product is formed by an initial charge placed in the furnace and comprised of quantities of hot metal, scrap, lime, ore, and spar, and oxygen blown into the furnace at some known rate for a given period of time and from some set lance position. By the term "lance" is meant the tool (which is in the shape of a lance) with which oxygen is blown into the mass of molten metal within the furnace. The furnace, which is maintained at a high temperature level in the neighborhood of 1200° C. to 1650° C., processes the charge to produce some quantity of steel, of some analysis and at some end-point temperature, along with some slag, flue gases and losses to thereby complete a heat, as is taught by D. Schroeder et al. in U.S. Patent Specification No. 3,561,743. There, the oxygen content of the molten bath within the basic oxygen furnace ("BOF") was measured by sensors for stack gas analysis and by feedback computation devices, to effect control of positioning the lance oxygen, and to provide heats of specified end-point carbon.

In another, completely different method to make carbon steel, the electric arc process, at least one supported electrode is positioned above a molten metal volume, within the charge materials, in an enclosed furnace containing a molten metal tapping outlet and charging inlets. The charge materials can include chip or granular pig iron, steel scrap, carbon, and lime ("CaO"), which are melted by the electrodes at a temperature of about 1600° C. to 1700° C. produced by an electric arc.

Such electric arc furnaces are described in U.S. Patent Specification No. 3,985,545 (Kinoshita). There, molten metal collects, drop by drop in the bottom of the furnace, after having been melted by the arc and passing through a slag layer which acts as a filter. In the course of the melting reaction carbon monoxide ascends through the molten bath and reacts with oxygen, or oxidizes carbon powder, to form carbon dioxide. The slag layer decarbonizes and desulfurizes the molten steel droplets, which descend through the slag layer to the bottom of the furnace. The slag layer functioned not only as a filter of the drops of molten metal but also as a check or stop for the drops just after they were produced by the arc and filtered. The slag layer was formed to cover the whole space below the lower tip of the electrodes, with the peripheral parts or edge portions of the slag layer turned upward to form a pan-like container. The pan-like slag layer also aided the sliding down of the raw materials in a smooth and sure manner along it to a position below the electrodes.

In U.S. Patent Specification No. 6,024,912 (Wunsche) the charge materials, such as a ferrous scrap mixture, are preheated using heat recovered from emitted hot waste gases from an electric arc furnace. This allows rapid achievement of normal flat bath operating conditions from cold start-up. In U.S. Patent Specification No. 6,238,452 B1 (Kremer et al.) a continuous flow of liquid pig iron melt was fed into an electric furnace along with continuous introduction of refining oxygen gas before the end of charging. This reduces the duration of the melting cycle even though the rate of injection of oxygen is not increased and allows charging without stoppage of heating by the electric arc. The traditional prior art method is described by Kremer et al. as running the electric furnace at maximum power to melt steel scrap (containing residual copper, nickel, and the like) for about 10 minutes, then switching off the electric arc, removing the furnace cover, charging with molten pig iron (typically containing excess 4.5% C and 0.6% Si) for five minutes, then after replacing the cover, switching on the electric arc, resulting in a ten minute shutdown.

In the standard, modern, batch electric arc furnace steel making, each new heat starts with a bottom pool of liquid metal, defined as "the heel" left in the furnace bottom from the previous heat. This served the following purposes: (1) The heel protects the bottom from too rapid an arc bore down without a liquid pool having formed to protect the bottom. When bore-down occurs too rapidly, the arc can go through the refractory bottom; (2) In DC furnaces, the heel is important to protecting the bottom anodes from the arc. If too little heel is present, damage occurs to the anode bottom and the anode bottom can be used for a smaller number of heats. The size of this heel left in the furnace was known to vary in size.

Attempts have been made to measure the depth of heels in DC furnaces so that a sufficient depth of heel could be maintained to protect the anode bottom. The usual practice was to leave more of a heel of product than required, usually 10 wt % to 20 wt % of the previous heat. This meant that from 10 wt % to 20 wt % of the heat was not poured, with a resulting tremendous loss of efficiency. Since the heel left in the furnace is a low-carbon liquid, it would have to be recarbonized by adding carbon, which can take considerable time, and was not completely predictable.

The usage of hot metal starter heels in electric furnaces had been limited mostly to the few integrated steel plants having blast furnaces and electric arc furnaces. The number of DC furnaces in integrated steelworks of the world are also more limited than AC furnaces in these plants. While electric arc carbon steel production provides a lower initial cost as compared with a blast furnace-converter steel manufacturing methods and adjustment of production amounts is easier; there is still a need to increase the production rate and losses associated with retaining a molten heel from the previous run.

In view of this, one of the main objects of the invention is to increase the production rate of electric arc carbon steel production. Another object is to reduce or eliminate the molten heel retained from a previous heat yet still protect bottom DC electrodes in the furnace at the start of the next heat.

SUMMARY OF THE INVENTION

The above needs and objects are met by providing a process of operating a DC electric arc furnace in a batch process to produce steel, comprising adding raw iron bearing material, carbon and lime to the furnace, applying current though at least one electrode to provide an arc and supplying oxygen to react and melt the materials to produce molten slag and molten carbon steel; the improvement comprising pouring all the molten carbon steel produced to provide an empty furnace and then adding molten metal to the empty furnace before its next batch operation. The molten metal will preferably comprise pig iron (solid hot metal with a general composition of: C 3.5–4.5%; Mn <1.0%; Si <0.6%; S <0.1%; P <0.3%; with the rest iron). The DC furnace will generally have top and bottom electrodes and the added molten metal will cover at least 100% of the bottom electrodes. This process adds up to utilization of 20 wt % additional molten carbon steel to the initial heat.

The invention also relates to a process of operating a DC electric arc furnace containing top and bottom electrodes, in a batch process to produce molten carbon steel, comprising the steps: (1) providing a furnace empty of molten metal and metal scrap, the furnace comprising a furnace bottom having upward sides and having at least one electrode having a top portion in the furnace bottom, at least one top electrode, an oxygen lance within the furnace, charging openings for raw materials; and exits for slag and molten metal; and then (2) adding molten metal to cover 100% of the furnace bottom electrodes; (3) adding solid raw iron bearing material, carbon and lime; and (4) applying current through the top electrode to provide an arc and supplying oxygen through the oxygen lance to react and heat the raw materials, producing a molten metal layer on top of the furnace bottom and a covering top slag layer, where the reaction generates CO which, along with any carbon, reacts with $O_2$ to form a first rate of CO generation during which CO and $CO_2$ bubble through the slag; and (5) stopping the reaction and pouring out all of the molten carbon steel and molten slag produced at a predetermined molten bath carbon concentration, to provide an empty furnace for the next batch process. The molten metal added in step (2) should preferably be above the bottom electrodes. This method is shown in block diagram form in FIG. 5 of the drawings.

With an initial hot metal heel, early carbon monoxide formation assures the shortest time to form a stable arc for obtaining the highest power input rate. The hot metal heel allows more of the heat to be tapped as product thereby increasing heat size and yield and protects the bottom electrode (anode) at the start of the new batch. The only disadvantage to this process is the time taken to tap out the existing heel and replacing the heel with hot metal. However, this time is more than made up for by the increases in power input rate, due to an earlier stable arc that allows higher power input rates.

The most important iron bearing raw materials used in the process are scrap, DRI (direct residual iron), pig iron, carbon and lime. All of these, can be melted and held in a furnace, preferably a channel induction furnace, associated with the DC electric arc furnace and used to add molten metal as the first part of a new heat.

BRIEF DESCRIPTION OF THE DRAWINGS

For a better understanding of the invention, reference may be made to the preferred, non-limiting embodiments exemplary of the invention, shown in the following drawings, in which.

DESCRIPTION OF THE PREFERRED EMBODIMENTS

The method of manufacturing steel using an electric arc furnace has the following advantages as compared with the conventional steel manufacture method in which blast furnace and converter are combined ("blast-furnace steel manufacture method"): (1) initial cost for investment is small as compared with a blast furnace converter steel manufacture method; (2) adjustment of production amount is easy; and (3) it is able to easily deal with various changes in the main materials.

As a result of recognition of these advantages, the cases where a steel manufacture method using electric arc furnace is selected are recently increasing for the manufacture of melted steel. In order to increase the production rate of electric arc furnace steel making, an increase in the amount of oxygen used causes an increase in the energy input rate by oxidizing carbon to carbon dioxide. The oxygen is lanced into the bath. Carbon is in the metal bath and/or injected into the bath. The objective is to melt, refine, and superheat the metal bath to a tapping temperature and carbon wt. %, preferably from about 0.03 wt. % to 0.30 wt. % for the steel grade being produced, in the shortest time period (tap-to-tap time). To determine if the tapping temperature is reached, a thermocouple reading is taken without stopping the process. Usually, for determination of the bath carbon, the process was stopped and a sample taken for analysis. When oxygen is lanced into a metal bath as in a converter, it oxidizes oxidizable elements that may be combined in the raw materials, that is, C, Si, Mn, Cr, and Fe. As long as sufficient carbon is in the molten metal bath, sufficient CO and $CO_2$ will be generated to maintain an appropriate, top foamy slag height. Very importantly, as the end of the steel making process in the electric arc furnace is approached, more iron is oxidized and lesser carbon is oxidized. As this occurs, less CO and $CO_2$ will be generated and the height of the foamy slag will begin to collapse.

With sufficient CO and $CO_2$ evolution, the foamy slag height can be maintained over the tip of the top electrodes. Under these conditions the increase in molten bath temperature can be calculated with precision from the initial thermocouple reading. By maintaining sufficient carbon in the molten metal bath and oxygen lancing to the molten bath, CO and $CO_2$ evolution sufficient to maintain the foamy slag height is maintained until the end of the steel making process. As the end of the steel making process approaches, 0.15% to 0.25% carbon in the molten bath, less of the lance oxygen is used to make CO and $CO_2$ and more goes to make FeO. As this happens, there is not enough CO and $CO_2$ formed to maintain the height of foamy slag and the foamy slag height will start to decrease.

Figure 1:
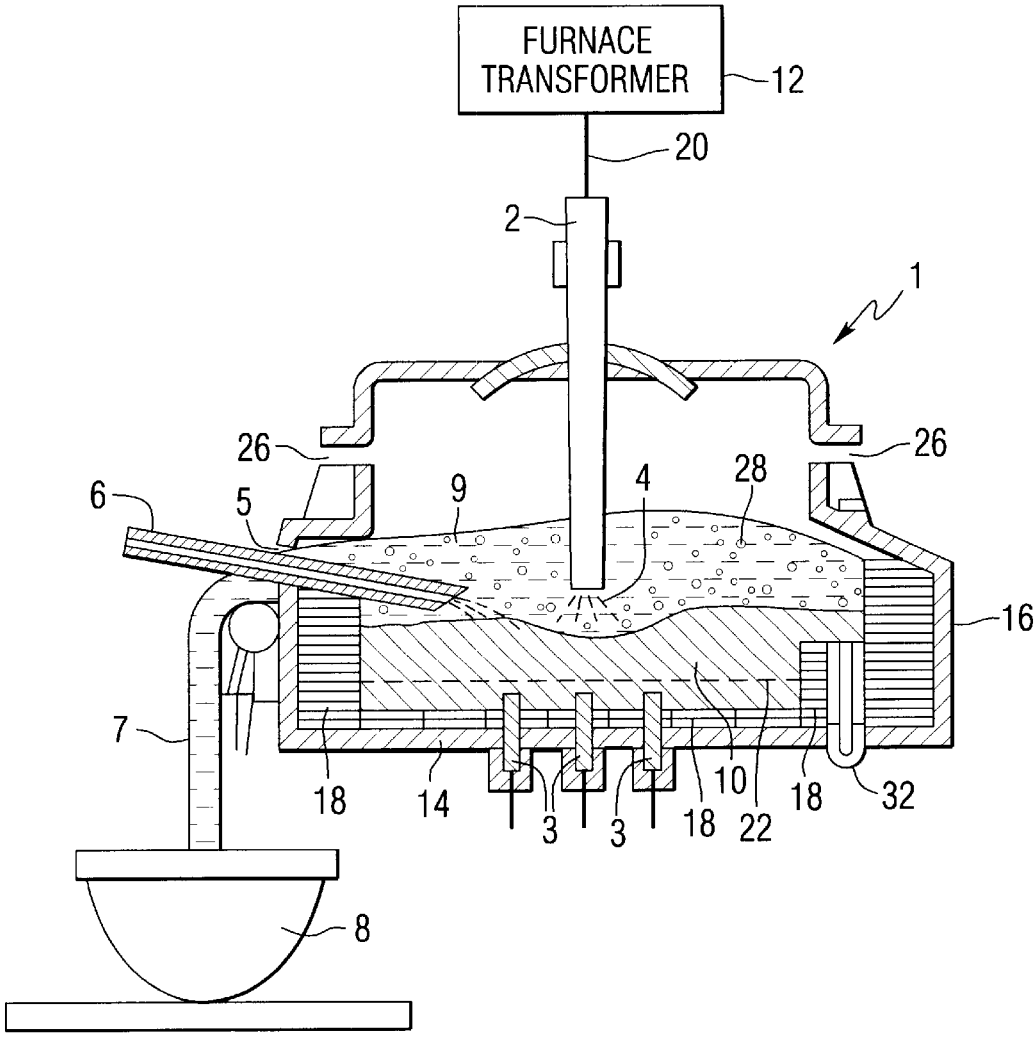
FIG. 1 shows a longitudinal cross section of usual DC electric arc furnace in which the present invention is conducted showing the slag foaming state, the molten metal produced and the usual amount of molten metal not poured off (the heel) and used to start the next batch.

Referring now to FIG. 1, a batch DC electric arc furnace 1 is shown in mid-operation of a run, where a main charge of solid raw material, consisting of iron containing scrap, and one or more materials selected from pig iron, solid pig iron, reduced iron and other iron containing materials are added to the furnace through a plurality of charge openings such as 26 and heated by means of arc 4 generated between the top electrode 2 and the bottom electrodes 3, through the scrap and molten metal in the furnace. The bottom electrode (s) 3 can be of a conductive pin, fin, billet, or the like type of, for example, steel or other metal. These batch DC electric arc furnaces usually have a capacity of about 120 tons to 180 tons. During operation, the outlet 5 for slag 9 from the furnace is completely closed during the time zones (dissolution, refining, and heating stage) until the heat is ready to tap to assure as constant a basicity as possible. Then, during the refining and heating stages, various reactions including decarburization from the melted steel 10 take place and, in the electric arc furnace 1, and gases mainly consisting of carbon oxides (CO and $CO_2$) are generated. In addition, the slag 9 formed by lime and the refining reactions has CO and $CO_2$ bubbling through it as shown (by bubbles 28) in FIG. 1, and its height increases, causing a foamy slag. A calculation is then made to determine the amounts of hi-cal (high calcium oxide lime - CaO) and dolomitic lime (MgO) needed to obtain a B4 (B4=CaO +MgO/$SiO_2$ +$Al_2$, $O_3$)slag basicity of between 1.8 and 2.3 at the end of the heat. As long as sufficient CO and $CO_2$ is bubbling through the slag 9, the slag height will be at a maximum and a shunted arc 4 will exist. Refractory material 18 protects the bottom 14 of the furnace 1 as well as bottom electrodes 3 and the furnace sides 16.

Figure 2:
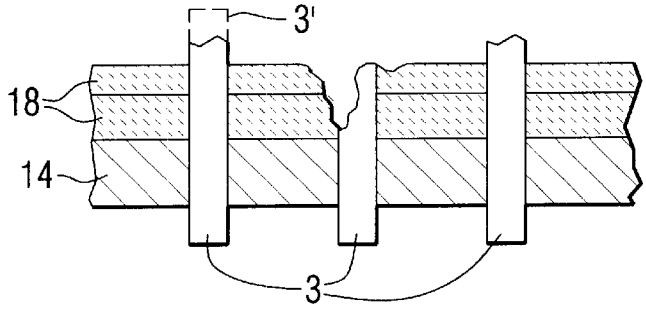
FIG. 2 shows the effect on the bottom electrodes of a DC electric arc furnace if too little molten metal is poured off at the end of a run and a new run started without enough molten heel, showing erosion of electrodes and the refractory bottom.

In addition to forming a foamy slag 9 of sufficient height, the foamy slag 9 forms a thick blanket layer above the metal bath 10 that limits heat loss to a constant, low rate allowing minimal loss of the bath temperature after an initial temperature is taken when the bath is completely molten. This allows prediction of the increase in bath temperature within the precision of the thermocouple reading for temperature increases of up to 66° C. (150° F.). FIG. 1 also shows slag release 7 and slag pot 8. Slag usually contains oxides such as $SiO_2$, CaO, $Al_2O_3$, $FeO_2$, MnO, MgO, etc. At the end of our run the slag 9 is poured and then about 80 wt % to 90 wt % of the heat, that is the molten metal/steel 10 formed is also released through molten metal tap 32. Enough molten metal is usually left to provide a level shown by the dotted line 22 so that the bottom refractory 18, and bottom electrodes 3 are protected during the next batch start-up. In this invention, however, the entire heat is released through molten metal tap 32 at the end of a run so the furnace 1 is empty of all metal, adding 10% to 20% additional molten product metal for processing into billets and the like. This, however, leaves the bottom refractory 18 and bottom electrodes unprotected, and the electric arc will erode not only the bottom electrode tips 3', but the electrode body itself and layers of refractory, possibly deep into the refractory nearly to the furnace bottom 14, as shown in FIG. 2. In this invention, to protect the dry furnace bottom and bottom electrodes, an initial amount of hot metal is poured, herein defined as the "initial metal pour", into the empty furnace at the beginning of the run, preferably to the level shown by dotted line 22, although an amount sufficient to cover just the top of the exposed bottom electrode 3 (100%) can also be used. If under 100% coverage then the anodes will melt and the refractory around them will erode. Thus, from about 5% to 20% of the end heat can be initially poured. The temperature of the initial metal pour can be from about 1400° C. to about 1500° C., preferably from about 1450° C. to about 1500° C., and it should be heated and held in a heating apparatus having low energy requirements, such as an inductor furnace or blast furnace, or preferably a channel induction furnace, shown as 40 in FIGS. 3–4. The inductor furnace will operate at over 1320° C. The arc is initiated and startup begun within about 3 minutes of pouring the molten metal. If the initial metal pour is below 1400° C. then some of the sensible heat from the initial metal pour will not be present to decrease the energy required from other sources. The heating apparatus should be associated with and disposed near or next to the batch DC electric arc furnace 1.

In this invention, the initial metal pour should have a high carbon content, about 3.00 wt % to 4.50 wt %, either from the melted carbon containing iron bearing materials and/or by the adding of cast iron and pig iron all of which can be the carbon containing iron bearing materials. Coke and coal will be the carbon bearing materials. The melting and heating rate of the channel induction furnace will be 10% to 20% of that of the arc furnace(s) that it is matched with. The hot initial metal pour will be ladled into the furnace replacing the previously tapped heel. The charge will not be dropped and/or an arc struck until the hot metal has covered all of the bottom furnace anodes. Electrode regulation will be done to take advantage of the high carbon heel. As soon as the arc becomes stable enough, the power will be increased. As soon as possible, oxygen will be made available to the heel so carbon monoxide starts bubbling up through the slag fluxes to form a foamy slag as early in the heat as possible. The goal is to melt and superheat the metal bath as quickly and efficiently as possible. By covering the anodes in the bottom of a DC furnace with a predetermined size of the heel, the useful life of the bottom is increased. The high carbon in the heel assures that carbon is available early in the heat to form carbon monoxide to foam the slag building materials used to form a slag that can be foamed. A foamy slag increases the efficiency of the steel making process.

Tapping the complete heat and then ladling in hot metal to form a predetermined heel size leads to (1) higher production of product per heat since the heel becomes part of the product, (2) higher production due to the sensible energy in the hot metal that does not need to be supplied from other energy sources, (3) higher production due to forming a stable arc earlier in the heat cycle, and (4) having a standard size heel that protects the anode that leads to a longer life of the anode.

Figure 3:
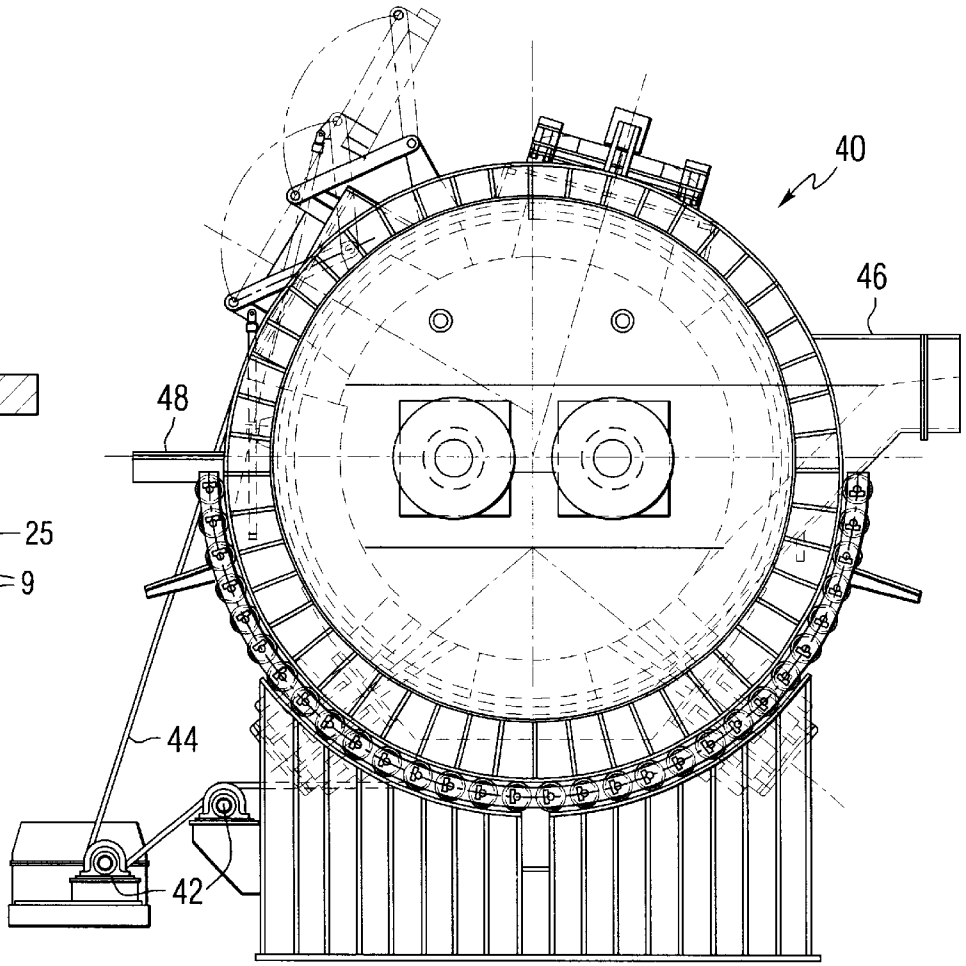
FIG. 3 shows in more detail the various reactions within the molten metal bath and slag volume and the various levels of the slag volume in the furnace during the heat, as well as an associated rotary channel induction furnace used to provide molten metal at the beginning of a run.
Figure 3:
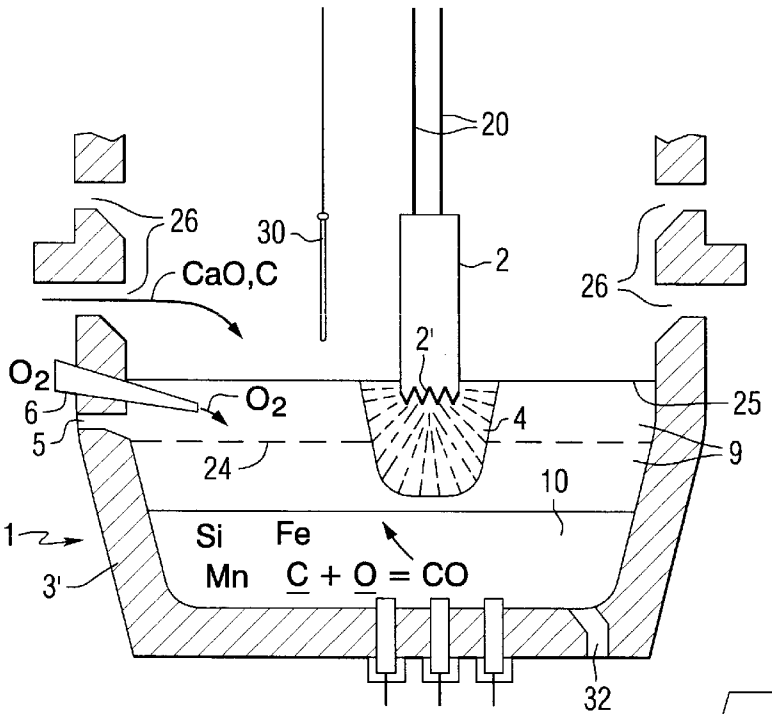

FIG. 3 shows, generally some of the material additions and reactions that take place and have been previously described. After the initial metal pour, from, for example, a rotating induction furnace 40, through the top of the furnace 1 or through openings 26, and after addition of other charge materials and starting the arc 4, the foamy slag index is high, and the foam thickness is low 24 in FIG. 3, not covering the top electrode tip 2 '. As the process continues the thickness increases to a higher level 25 in FIG. 3, covering the top electrode tip 2 ' causing a higher temperature arc and a decrease in resistance increasing effective arc current and changing the voltage parameters. Finally, as more FeO is formed in the slag 9 and carbon content in the bath 10 decreases, less CO is generated, less $CO_2$ is formed and the foamy slag layer 9 collapses back again to about level 24 causing the foamy slag index to increase, increasing resistance in the electrode tip. During this time, the current to the electrode must be such that the arc 4 is maintained. The current will vary depending on how deep it is in the slag 9. Furnace transformer 12, shown in FIG. 1, is used to step down voltage to the electrode bus 20. The furnace transformer 12 typically has secondary taps so that voltage to the electrodes can be selected for proper melting conditions throughout the heat.

Figure 4:
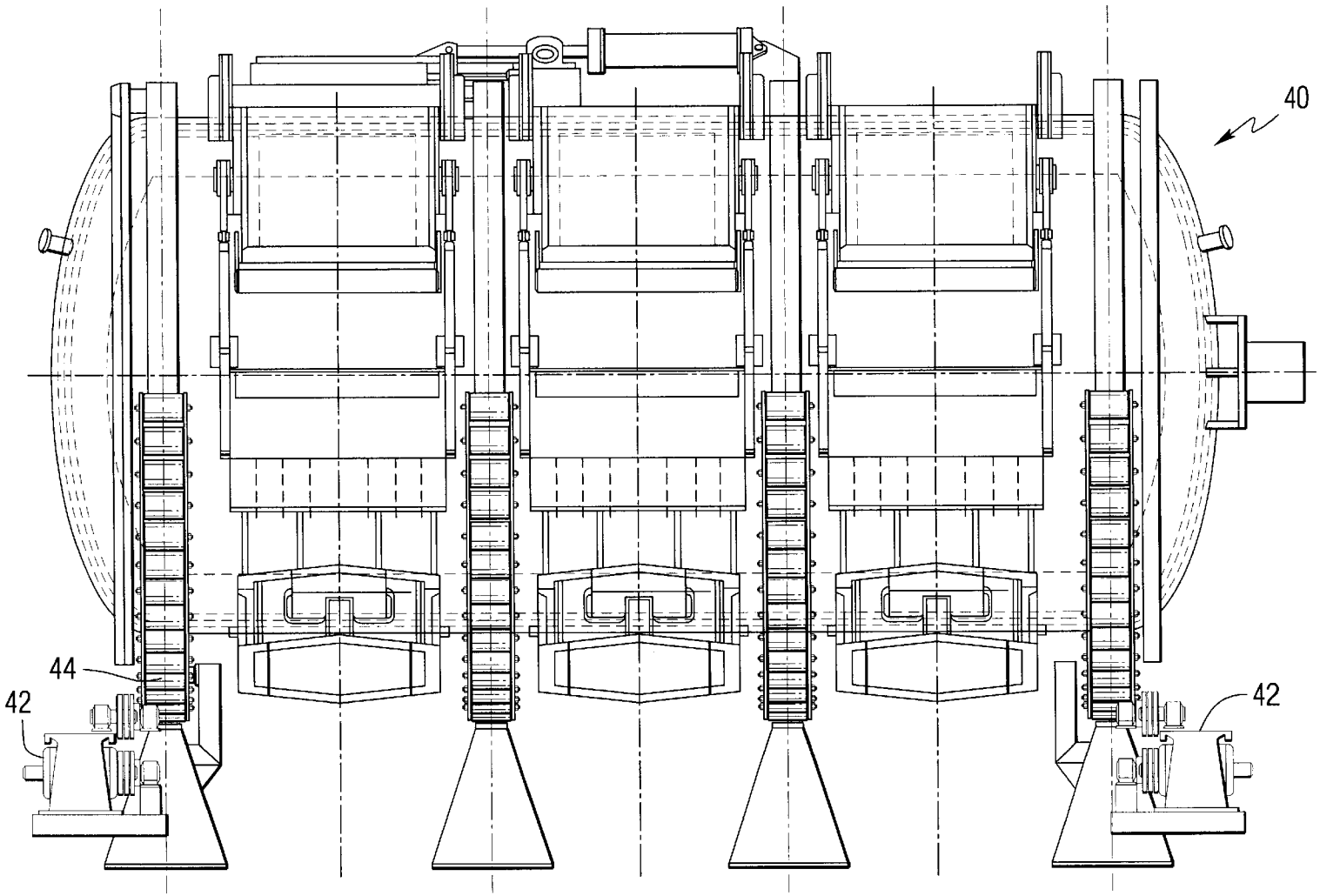
FIG. 4 is a side view of the associated induction furnace shown in FIG. 3.

As can be seen in FIG. 3, CaO, C and $O_2$ are added, among other ingredients to the furnace 1 which has bottom 14 and upward sides 16. Generally, added Fe reacts with $O_2$ from lance 6 to provide FeO which reacts with C to form CO and CO reacts with $O_2$ to $CO_2$. These basic reactions are well known as are the many other side reactions. Thermocouple 30 is also shown as are the slag tap 5 and molten metal tap 32. For sake of simplicity the top dome is not shown. A side view of a typical rotating channel induction furnace 40 is shown in FIG. 4. The induction furnace 40 is rotated by a plurality of motors 42 and a chain 44 or the like. The furnace operates generally at from about 1320° C. to about 1550° C. to provide a molten initial pour at temperatures described previously. The raw materials can be added through openings 46 and the molten metal poured through for example tap 48 into the DC furnace 1.

Figure 5:
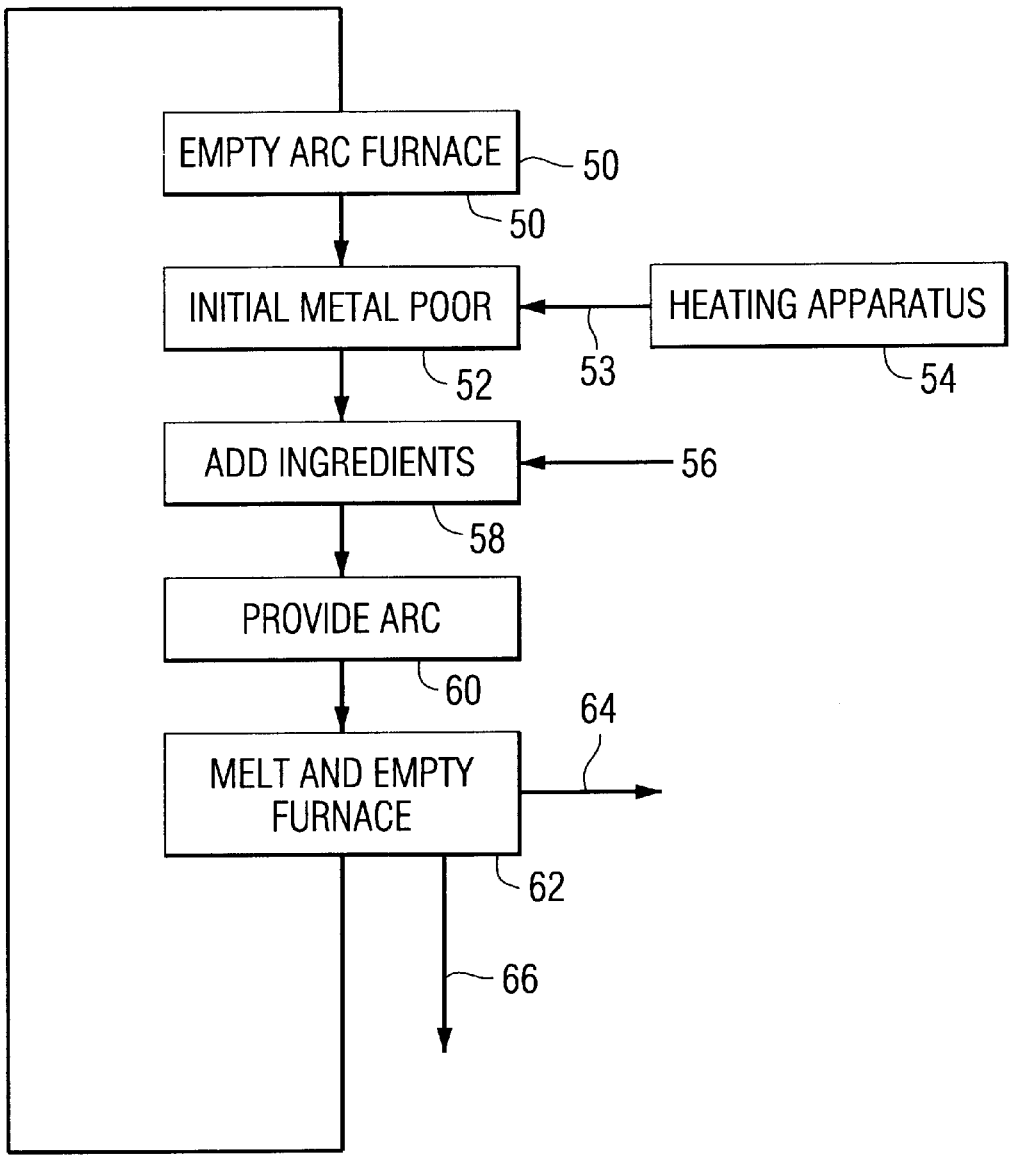
FIG. 5 is a block diagram of the method of this invention.

FIG. 5 shows the process of this invention where an empty furnace 50 is provided, the molten heel is added in step 52 as liquid metal 53 from, for example, a channel induction furnace 54 to provide the initial metal pour, followed by adding solid ingredients 56 in step 58, providing an arc in step 60, melting in step 62 and pouring slag 64 and molten metal 66 desired to empty the furnace. A cost analysis was run on the basis of producing 160 tons/hour of steel from a DC electric arc furnace using the process of this invention with a 20% heel of initial molten metal pour from a channel induction furnace. If the channel induction furnace would have an initial cost and installation of $20M, the process would break even in less than a year in one million ton/year meltshop.

The invention will now be further illustrated and defined by the following comparative example and non-limiting examples.

EXAMPLE

This example involves using DC electric arc furnace with a capacity of 160 tons as shown generally in FIG. 1, where low carbon steel is manufactured, where the outlet for slag is completely closed, and where at the end of heating, melting, superheating, and refining a heat of low carbon steel, the molten steel is completely tapped from the furnace and the slag is tapped off through a charging door. At the beginning of the batch, a high carbon hot metal heel is added to the empty furnace having a high carbon content of about 4.0 wt % having a temperature over 1450° C. Ladling in of the hot metal from a channel induction furnace can be while the furnace is level. After most of the hot metal is ladled in, the roof can be swung and the first charge of other raw materials such as scrap, pig iron, or HBI dropped. As soon as the roof is back in place, the arc is struck. With the more rapid establishment of a stable arc favored by formation of carbon monoxide from the high carbon in the heel, the power is increased faster than with little to no carbon in the heel in the normal process. This results in a faster heat due to sensible energy in the hot metal, the chemical energy from the carbon monoxide formed from the carbon in the hot metal, and the faster stabilization of the arc. This process provides lower power usage, lower electrode usage and shorter tap-to-tap times. A constant size liquid metal charge is use so as to completely cover the anode bottom. Carbon is introduced to increase the bath concentration of carbon. The electric power arc is made with carbon monoxide coming off the metal bath and the stability increases rapidly. The power is increased as the electrical arc stability increases. The using of a constant size heel assures the anode bottom will be covered and no damage to the anode will occur. A cost analysis using 20% initial hot metal follows.

Cost Analysis of 20% Hot Metal Usage

| ITEM | | RESULT | DIFFERENCE $/Ton L.S. | |
|---|---|---|---|---|
| Dolomit(e)ic | | lbs/Ton L.S. | 0.00 | 0 |
| Refractories | Reduced Cost | $/Ton | | −0.864 |
| Electrodes | Less Trode | lbs/Ton L.S. | −1.10 | −1.099 |
| KWHRs | Less KWHR | Ton L.S. | −128.55 | −7.713 |
| Liquid - Heel | | Tons/Ton L.S. | −0.10 | |
| Scrap | | Tons/Ton L.S. | −0.200659 | −20.066 |
| Sponge Iron, DRI | | Tons/Ton L.S. | 0.000000 | 0.000 |
| Pig iron | | Tons/Ton L.S. | 0.000 | 0.000 |
| Hot Metal | | Tons/Ton L.S. | 0.2000 | 23.000 |
| Mn-Alloy Addition | Extra Mn-Alloy | Tons/Ton L.S. | 0.03 | 0.011 |
| Iron Carbide | | lbs/Ton L.S. | 0 | 0.000 |
| Oxygen | Added Oxygen | SCF/Ton | 347.78 | 1.155 |
| Carburizer | Reduced Carbon | Lbs/Ton | 0.00 | 0.000 |
| Lime, W/WO Cor | Less Lime | Lbs/Ton | −24.5 | −0.983 |
| Slag Disposal | Less Slag | Tons/Ton L.S. | −29.35 | −0.015 |
| Burners | | n.a. | | 0.000 |
| Iron Ore | | Tons/Ton L.S. | 0 | 0.000 |
| Mill Scale | | Tons/Ton L.S. | 0 | 0.000 |
| Manganese Ore | | Tons/Ton L.S. | 0 | 0.000 |
| Oxygen Pipe | | | | 0.126 |
| Graphite | | Tons/Ton L.S. | 0 | 0.00 |
| Delta Heat Time | | −Mins Ht. Time | −17.428 | −12.077 |
| PRODN. CHANGE | | Added Tonnes L.S./Month | 24563 | −3.921 |
| TOTAL COST ABOVE BASE PRACTICE | | | | −22.45 |

What is claimed is:

1. A process of operating a DC electric arc furnace in a batch process to produce steel, comprising adding raw iron bearing material carbon and lime to the furnace, applying current through at least one electrode to provide an arc and supplying oxygen to react and melt the materials to produce molten slag and molten carbon steel; the improvement comprising pouring all the molten carbon steel produced to provide an empty furnace and then adding molten metal to the empty furnace before its next batch operation.

2. The process of claim 1, the improvement further comprising adding molten metal comprising hot metal.

3. The process of claim 1, the improvement further comprising use of at least one top electrode and at least one bottom electrode, where the added molten metal completely covers the bottom electrode height.

4. The process of claim 1, the improvement further comprising use of at least one top electrode and at least one bottom electrode, where the added molten metal level is over the bottom electrode.

5. The process of claim 1, the improvement further comprising heating the added molten metal at a temperature of from about 1400° C. to about 1500° C. in an associated channel induction furnace which operates between 1320° C. and 1550° C.

6. A process of operating a DC electric arc furnace containing top and bottom electrodes, in a batch process to produce molten carbon steel, comprising the steps:

(1) providing a furnace empty of molten metal and metal scrap, the furnace comprising a furnace bottom having upward sides and having at least one electrode having a top portion in the furnace bottom, at least one top electrode, an oxygen lance within the furnace, charging openings for raw materials; and exists for slag and molten metal; and then (2) adding molten metal to cover at least 100% of the furnace bottom electrodes;

(3) adding solid raw iron bearing material, carbon and lime; and (4) applying current through the top electrode to provide an arc and supplying oxygen through the oxygen lance to react and heat the raw materials, forming a molten metal layer on top of the furnace bottom and a covering top slag layer, where the reaction generates CO which, along with any carbon, reacts with $O_2$ to form a first rate of CO generation during which CO and $CO_2$ bubble through the slag; and (5) stopping the reaction and pouring out all of the molten carbon steel and molten slag produced at a predetermined molten bath carbon concentration, to provide an empty furnace for the next batch process.

7. The process of claim 6, wherein the molten metal added in step (2) consists essentially of a higher carbon metal.

8. The process of claim 6, wherein the added molten metal added in step (2) is at a level over the bottom electrode.

9. The process of claim 6, wherein the molten metal added in step (2) has a temperature of from about 1400° C. to 1500° C.

10. The process of claim 6, wherein the molten metal added in step (2) is added from an associated channel induction furnace which operates at from about 1320° C. to 1550° C.

11. The process of claim 6, wherein step (4) is started within 3 minutes of step (2).

12. The process of claim 6, wherein the productivity of the DC furnace is increased by 1) the size of the hot metal heel;

2) the sensible heat in the hot metal heel;

3) the carbon in the hot metal heel.

13. The process of claim 6, wherein more heats can be made before replacement of the anode bottom.

* * * * *